United States Patent [19]

Wada et al.

[11] 4,134,665

[45] Jan. 16, 1979

[54] SINGLE BATH-TYPE FILM DEVELOPING DEVICE

[75] Inventors: Yamato Wada, Soka; Shin Ishikawa, Saitama, both of Japan

[73] Assignee: Somar Manufacturing Company Limited, Tokyo, Japan

[21] Appl. No.: 872,337

[22] Filed: Jan. 25, 1978

[30] Foreign Application Priority Data

| | | | |
|---|---|---|---|
| Feb. 7, 1977 | [JP] | Japan | 52-12617[U] |
| Feb. 7, 1977 | [JP] | Japan | 52/12618[U] |
| May 16, 1977 | [JP] | Japan | 52-61462[U] |

[51] Int. Cl.[2] ..... G03D 3/06

[52] U.S. Cl. ..... 354/299; 354/323; 354/324; 354/327; 354/331

[58] Field of Search ..... 354/299, 307, 312, 315, 354/316, 323, 324, 326, 327, 328, 331, 335, 336, 337

[56] References Cited

U.S. PATENT DOCUMENTS

| | | | |
|---|---|---|---|
| 3,294,004 | 12/1966 | Benson | 354/324 |
| 3,811,767 | 5/1974 | Purnell | 354/307 |

*Primary Examiner*—Richard A. Wintercorn
*Assistant Examiner*—Alan Mathews
*Attorney, Agent, or Firm*—Watson, Cole, Grindle & Watson

[57] ABSTRACT

A single bath-type film developing device includes a developing tank, a developing and fixing liquid tank and a rinsing water tank, at least the latter two tanks being pivotable about an axis spaced therefrom for respectively altering the level of liquid and water therein relative to the developing tank. Conduits respectively interconnect the developing tank with the liquid and water tanks so that the developing tank is filled with the liquid when the liquid level is above the developing tank, and the developing liquid may be emptied back into the liquid tank and thereafter filled with rinsing water when the water level is above the developing tank. In accordance with another embodiment, the developing and liquid tanks are mounted on one surface of a pivotable support base, while the rinsing water tank and a storage tank are mounted on an opposite surface thereof. Conduits interconnect pairs of these tanks, and the developing tank is filled with developing liquid when it is uppermost. It may be emptied into the storage tank when still uppermost and, when the rinsing tank us uppermost, the developing tank may be filled with rinsing water and the storage tank may be emptied back into the developing liquid tank.

6 Claims, 27 Drawing Figures

SINGLE BATH-TYPE FILM DEVELOPING DEVICE

BACKGROUND OF THE INVENTION

1. Field of the Invention

This invention relates generally to a film developing device using a single bath-type developing and fixing liquid.

2. Description of the Prior Art

Film developing techniques and devices for carrying them out are known wherein a single developing and fixing liquid is utilized for the development and fixing of a sensitized photographic film, followed by water rinsing, thereby completing the development and fixing of the photographic film.

Such a liquid generally contains a metal, anhydrous sodium sulfite hydroquinone, potash alum sodium hydroxide, sodium thiosulfate nitrobenzivitasol, mithasol, and nitrate. The film is dipped in some manner into the liquid, after which it is rinsed with water, for carrying out the developing and fixing operation.

The present invention relates to a film developing device utilizing a developing and fixing liquid of the type referred to above, for developing a plurality of sheets of films, such as microfiche, without requiring the operator to dip the film into the liquid.

It is therefore an object of the present invention to provide a film developing device wherein a sensitized film may be submerged in a developing and fixing liquid, after which the liquid is drawn off and rinsing water washes the developed film after which the water is discharged and the film is dried.

Another object of the present invention is to provide such a device wherein the developing and fixing liquid and the rinsing water are supplied to and discharged from a developing tank through conduits interconnecting the developing tank with liquid and water tanks so as to avoid a manual dipping of the sensitized film by the operator into the developing liquid and the rinsing water thereby possibly causing a spilling thereof.

A further object of this invention is to provide such a device wherein the developing liquid and rinsing water are supplied to and discharged from the developing tank by gravity, thus dispensing with a drive mechanism for transferring the liquid and water to and from the developing tank.

Other objects, advantages and novel features of the present invention will become more apparent from the detailed description of the invention when taken in conjunction with the accompanying drawings.

SUMMARY OF THE INVENTION

In accordance with the invention, a film developing device of the single bath-type is provided as including a developing tank, a tank containing developing and fixing liquid and a tank containing rinsing water. The latter two tanks are mounted for pivotal movement about an axis spaced therefrom for respectively altering the level of liquid and water therein relative to the developing tank. Flexible conduits interconnect the developing tank respectively with the other two tanks so that, depending on the level of the liquid or water relative to the developing tank, the developing tank may be filled with the developing and fixing liquid, drained back into the liquid tank and subsequently filled with rinsing water after which it is likewise drained back into the water tank. Valving in the conduits permit such a flow of liquid and water into and out of the developing tank. The developing and rinsing water are therefore maintained separate without mixing while being supplied to and discharged from the developing tank.

The filling and emptying of the developing tank with developing liquid and rinsing water may alternatively be carried out with the use of a developing and fixing liquid containing tank and a developing tank mounted on one side of a pivotable base plate, with a rinsing water containing tank and a storage tank mounted on the opposite side of the base plate. Pairs of the tanks are appropriately interconnected by conduits so as to carry out the developing tank emptying and filling operation depending upon the upward position of the base plate surfaces and the tanks mounted thereon.

DETAILED DESCRIPTION OF THE INVENTION

Figure 1:
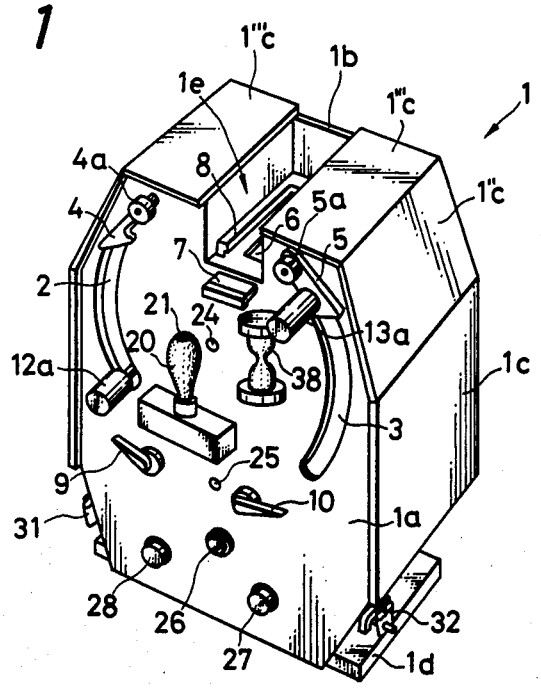
FIG. 1 is a perspective view showing a front side of a developing device according to one embodiment of the present invention.

Turning now to the drawings wherein like reference characters refer to like and corresponding parts throughout the several views, a film developing device according to one embodiment of the invention is shown in FIG. 1 as including a casing 1 of a polygonal shape secured to a base plate forming a support body 1*d*. Front and rear plates 1*a* and 1*b* are enclosed by side plates 1*c*, and each of these plates may be transparent to facilitate viewing of the positions of the tanks to be described hereinafter.

Figure 3:
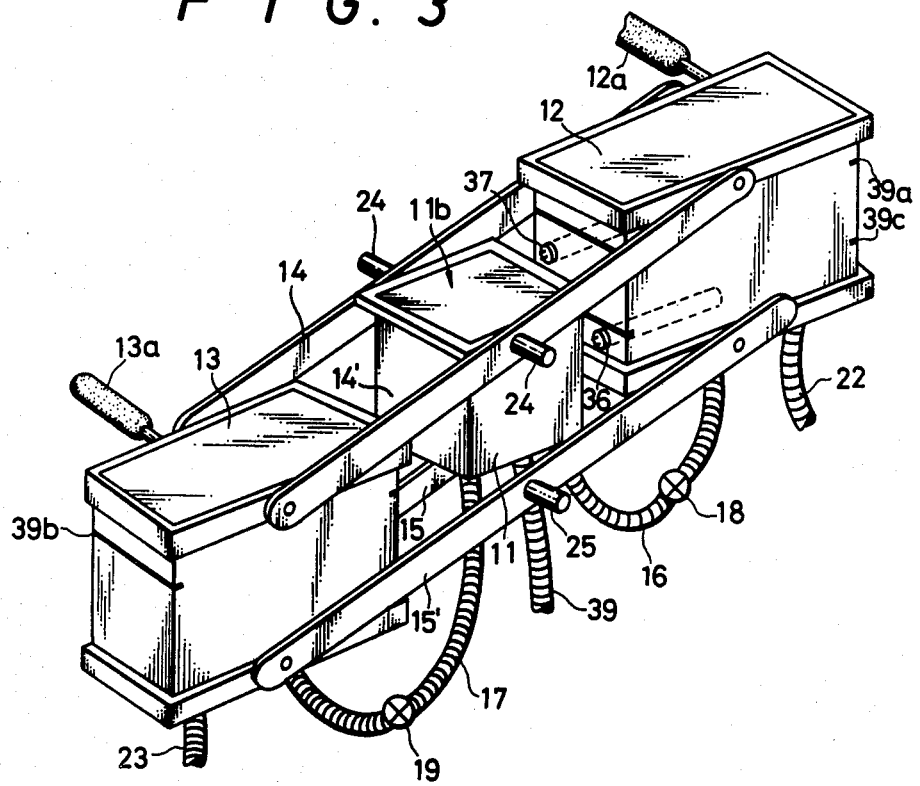
FIG. 3 is a perspective view of a developing tank, a developing and fixing liquid tank, and a rinsing water tank contained within the FIG. 1 device, but shown at a slightly enlarged scale.

As shown in FIG. 3, a developing tank 11 is fixedly mounted in any normal manner at the center of the casing between vertically spaced shafts 24 and 25. A tank 12 containing a quantity of developing and fixing liquid and a tank 13 containing rinsing water are mounted for pivotal movement relative to the developing tank by means of upper levers 14,14' and lower levers 15,15' to shafts 24 and 25 respectively extending outwardly of the upper and lower pairs of levers. Hand operating bars or grips 12*a* and 13*a* are respectively secured to tanks 12 and 13 for pivoting same about the axes of shafts 24 and 25 which are supported by and extend through suitable openings provided in plates 1*a* and 1*b*. Bars 12*a* and 13*a* extend outwardly through arcuate slots 2 and 3 provided in front plate 1*a*. Locking pawls 4 and 5 are pivotally mounted to plate 1*a* by means of their respective shafts 4*a* and 5*a* for locking handle bars 12*a* and 13*a* in their respective uppermost positions (as typically shown in FIG. 1 for bar 13*a*).

The casing has a depressed portion 1*e* at the top thereof adjacent upper plates 1'''*c* and 1''''*c*, and an opening 6 is provided in a bottom wall of this depressed portion and is superimposed over top opening 11*b* (FIG. 3) of developing tank 11. A light shielding plate 7 is provided for sliding beneath opening 6 through a suitable slot in plate 1*a* so as to shield external light from entering the developing tank through opening 6. Also, a frame bracket or shoe 8 is provided on the bottom wall of depressed portion 1*e* to facilitate sliding reception of a drying unit 40 shown in FIG. 5.

The side walls and bottom wall of developing tank 11 are formed of opaque material, and a flexible conduit 16 interconnects tank 11 with tank 12 through the bottom walls thereof, while a second flexible conduit 17 interconnects tank 11 with tank 13 through the bottom walls thereof (see FIG. 3). Tank 12 contains a quantity of developing and fixing liquid, and tank 13 contains a quantity of rinsing water. Valves 18 and 19, respectively provided in conduits 16 and 17, are mounted on the inner surface of front plate 1*a* of the casing. Valve operating handles 9 and 10 of typical stopcocks are mounted on the outer surface of front plate 1*a* are are respectively connected to valves 18 and 19 for the manual opening and closing of same as in any normal manner.

Another flexible conduit 39 extends outwardly through the bottom wall of the developing tank and communicates with a flexible bulb diaphragm 20 mounted on the outer surface of plate 1*a* (FIG. 1). An air vent opening 21 is provided in the upper portion of bulb 20 so as to facilitate agitation of the liquid in the developing tank upon manually squeezing and relaxing the bulb. Flexible conduits 22 and 23 likewise extend outwardly through the bottom walls of respective tanks 12 and 13 through which the contents of these tanks may be discharged as valves provided therein (not shown) are operated by respective valve operating handles 31 and 32 mounted on base plate 1*d* of the casing.

An electric heater 36 extends inwardly of tank 12 for heating the liquid therein, and a thermostat 37 likewise extends into tank 12 for controlling the current to heater 36 so as to maintain the temperature of the liquid within the liquid developing and fixing tank at a predetermined temperature.

Figure 2:
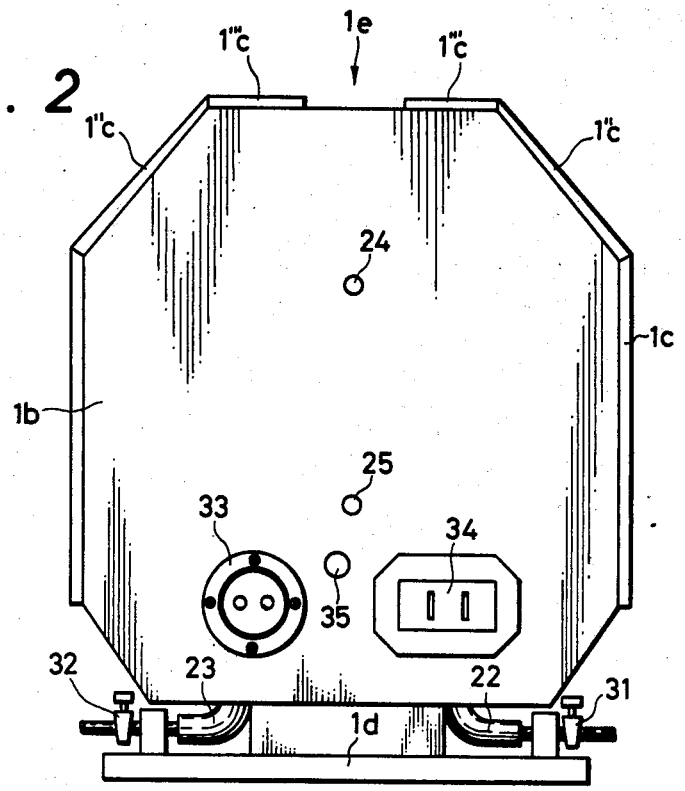
FIG. 2 is a rear elevational view, in slightly enlarged scale, of the FIG. 1 device.
Figure 5:
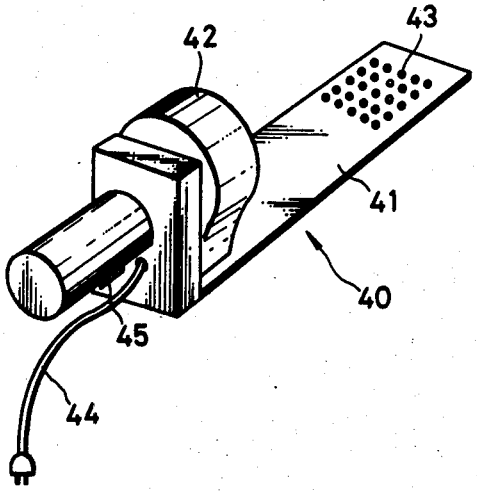
FIG. 5 is a perspective view of a drying unit usable with the FIG. 1 embodiment.
Figure 6:
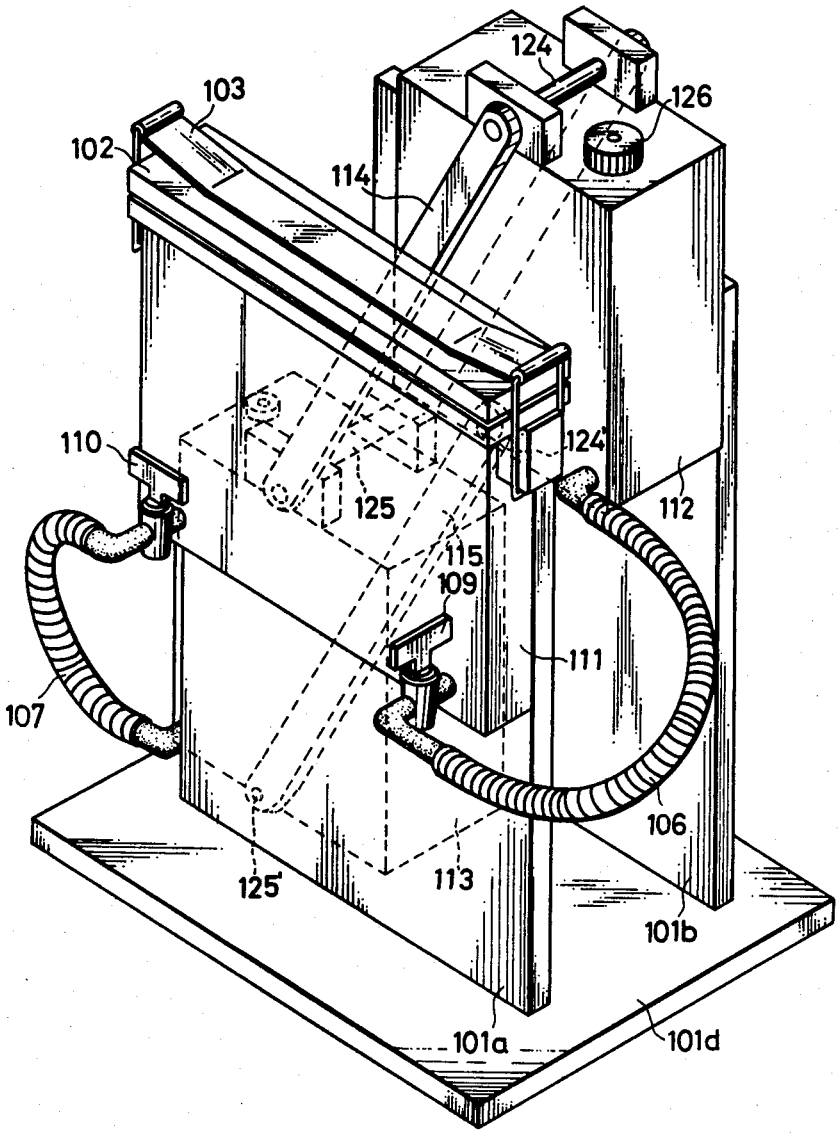
FIG. 6 is a perspective view of another embodiment of a device according to the invention.
Figure 7:
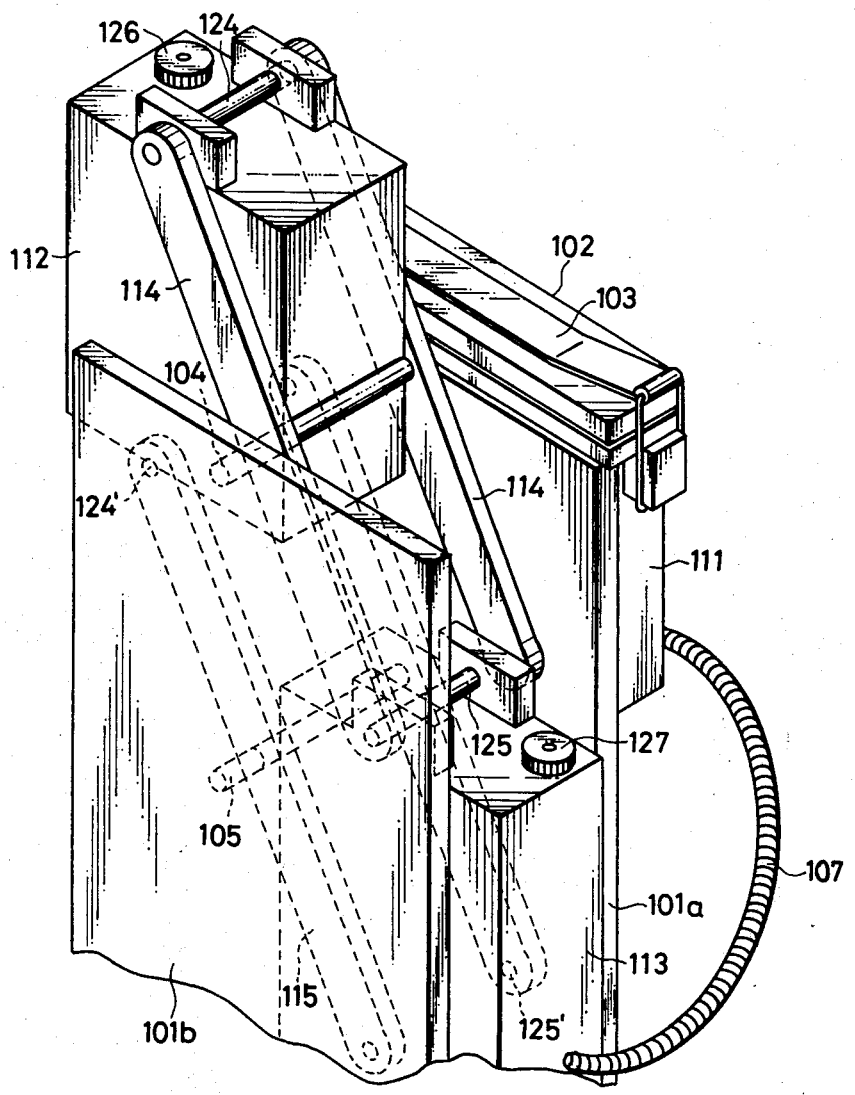
FIG. 7 is a perspective view showing a part of the rear of the FIG. 6 device.
Figure 8:
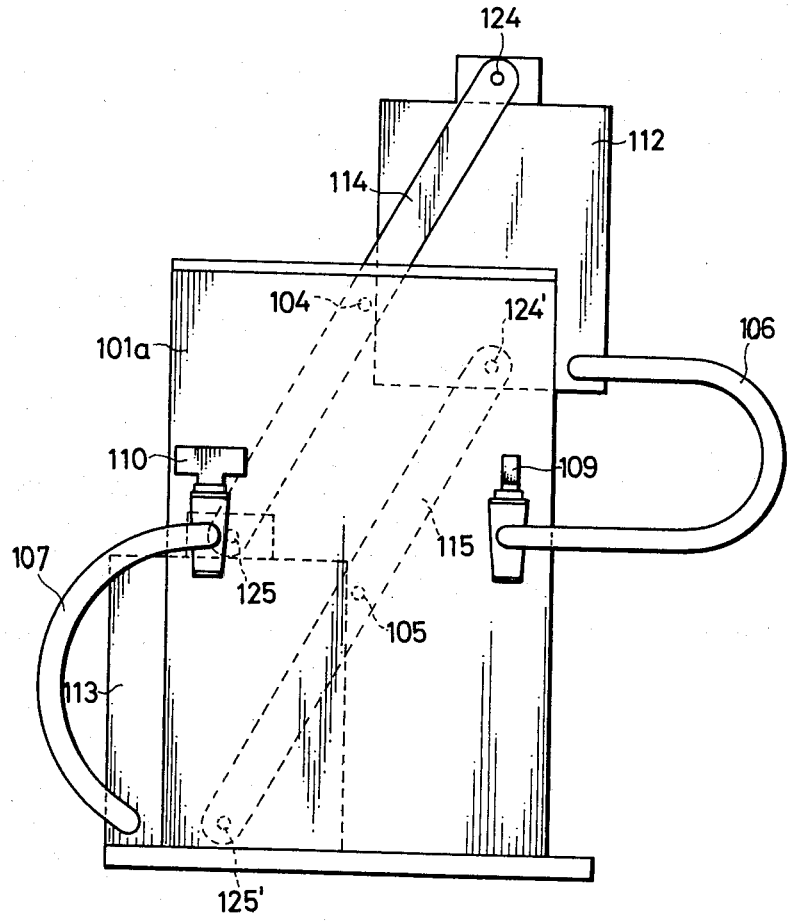
FIG. 8 is a side elevational view of the FIG. 6 device.
Figure 9:
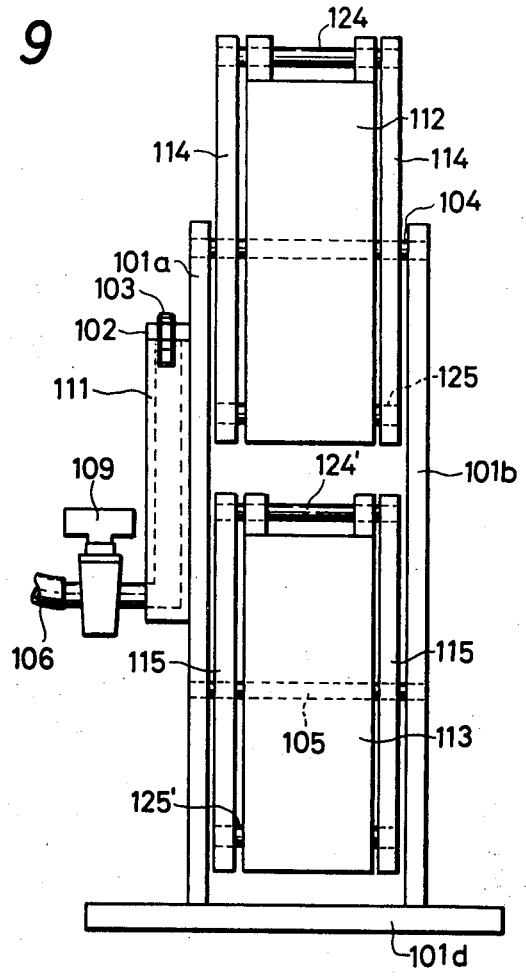
FIG. 9 is an end elevational view of the FIG. 6 device.

As shown in FIG. 2, an electrical input socket 33 is mounted on rear plate 1*b* of the casing for connecting the heater to an electrical power source. Also mounted on plate 1*b* is an output electrical socket 34 electrically connected to socket 33 and provided for the reception of a cord 44 of drying unit 40 (FIG. 5). And, mounted on front plate 1*a* of the casing are an electric power source lamp 27 for indicating when the device is connected to an electric power source, a heater switch 26, and an indicating lamp 28 for indicating an ON position of the heater.

Sloping top plates 1'*c* and 1''*c* are removably mounted in place so that, when removed, fresh rinsing water and fresh developing and fixing liquid may be respectively supplied to tanks 13 and 12 underlying these plates. The tanks may be filled with optimum amounts of such liquid and water to lines 39*a* and 39*b* respectively provided on tanks 12 and 13. Also, an index line 39*c* is provided on tank 12 near the bottom wall thereof for indicating the position of tank 12 when swung to a position above developing tank 11 so that, when valve 18 is opened by the operation of handle 9, the liquid within tank 12 may be transferred into the developing tank. A corresponding index line (not shown) may be provided on tank 13 for indicating the position of tank 13 when swung to a level above the developing tank so that, when valve 19 is opened by the operation of handle 10 as will be more fully described hereinafter, the water may be transferred into developing tank 11. An hourglass 38, pivotally mounted on front plate 1*a* of the casing, may be provided for timing the developing, fixing and water rinsing operations.

Heater 40 includes a mounting plate 41 which may be slid into the shoe or slide bracket 8 mounted above opening 6 so as to retain the heater in place for drying the developed and rinsed film in tank 11 after plate 7 has been withdrawn. The heater further includes a hot air fan 42 for blowing heated air downwardly through an opening therein (not shown) superimposed over opening 6. Air vent openings 43 are provided at the free end of plate 41 through which heated air may escape from tank 11. An ON-OFF switch 45 may likewise be provided on the heater.

Figure 4A:
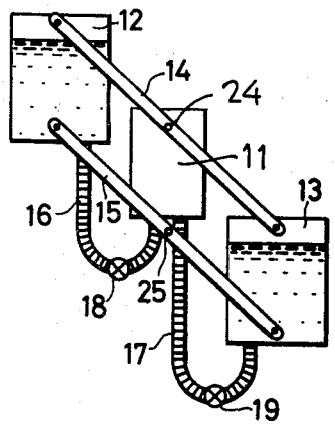
FIGS. 4A to 4D are side elevational views showing the manner in which the outer tanks of FIG. 3 are shifted relative to the central tank during the film developing and rinsing operations.

In developing a plurality of films, such as microfiches, in sequence with the aforedescribed device according to the invention, an electric power source is connected to socket 33 thereby lighting lamp 27 for confirming the electrical connection. Plate 1'*c* may then be removed to facilitate a filling of tank 12 with a developing and fixing liquid up to index line 39*e*, tank 12 having a capacity of about 2200 ml of liquid to this index line. In this same manner, when plate 1''*c* is removed, tank 13 may be filled with rinsing water up to its index line 39*b*, tank 13 having a similar capacity to that of tank 12. Plates 1'*c* and 1''*c* are then placed back into their positions on the casing, handle 12*a* is moved back to its uppermost position whereupon tank 12 is swung to a position above the top of tank 11 as shown in FIG. 4A, and handle 12*a* is locked in its uppermost position by locking pawl 4.

When main switch 26 is closed, heater 36 is energized and lamp 28 is lit. When the developing and fixing liquid is heated to a suitable temperature, such is confirmed by indicating lamp 28 designed at that time to turn off. Thus, the device is readied for carrying out the film developing and rinsing operations.

Figure 4B:
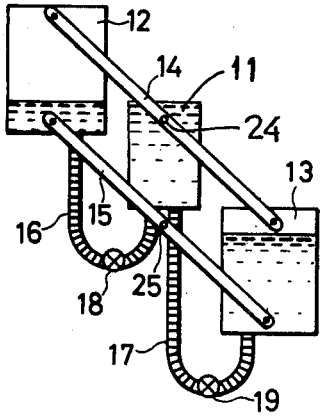

First valve 18 on first conduit 16 may then be opened upon the turning of valve operating handle 9 so that developing and fixing liquid flows by gravity from tank 12 into developing tank 11. The discharge of liquid from tank 12 into tank 11 continues until the levels of liquid in tanks 12 and 11 are substantially even as shown in FIG. 4B. Index line 39*c* will confirm this level. The flow of liquid then is stopped by closing valve 18 upon operation of handle 9. The film, supported by a film carrier (not shown), is then inserted into shoe 8 and plate 7 is withdrawn to allow the film to drop into tank 11.

Thereafter, plate 7 is closed over opening 6 and the developing interval is timed by hourglass 38.

Figure 4C:
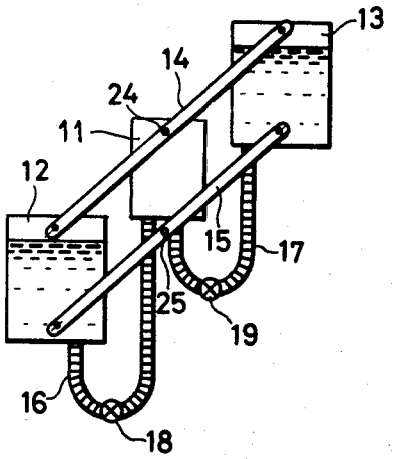
Figure 4D:
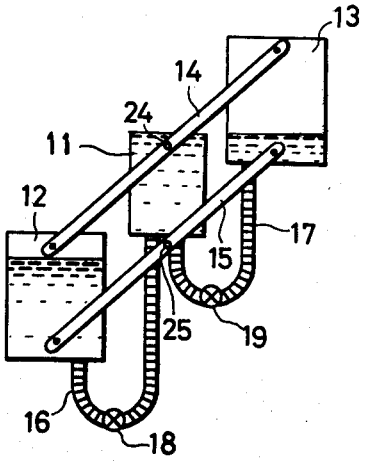

Bulb 20 may then be operated for agitating the liquid within developing tank 11 to aid in the developing process. Upon completion of the developing operation, locking pawl 4 is disengaged, and tanks 12 and 13 are swung about shafts 24 and 25 by means of handles 12*a* and 13*a* into a position shown in FIG. 4C wherein tank 13 is now situated above tank 11 with handle 13*a* in its uppermost position. Handle 13*a* is then locked in this uppermost position by locking pawl 5, and valve 18 is opened by the turning of handle 9. The developing and fixing liquid is then permitted to flow by gravity from tank 11 through first conduit 16 back into tank 12. Valve 18 is then closed and valve 19 is opened by the turning of handle 10 so as to permit the rinsing water to flow by gravity from tank 13 through second conduit 17 and into developing tank 11, as shown in FIG. 4D, so that the developed film may be rinsed. The time required for water rinsing is about 3 minutes, and may be measured by hourglass 38. Upon completion of the water rinsing operation, tank 13 is lowered relative to shafts 24 and 25 back to its position of FIG. 4A whereupon handle 12*a* is locked into its uppermost position by locking pawl 4. Valve 19 is then opened to permit the rinsing water to flow by gravity from tank 11 back into tank 13. With tank 11 now empty, plate 41 of drying unit 40 is inserted into shoe 8, cord 44 is connected to socket 34, plate 7 is withdrawn and switch 45 of the heater is turned to its ON position. Hot air is then delivered by means of hot air fan 42 into tank 11 and is vented through openings 43 so as to thereby dry the interior of tank 11 as well as the film therein. After the developed and water rinsed film is dried, it is removed from tank 11. This, then, completes a cycle of developing, water rinsing, and drying operations, without the operator at any time required to manually dip the film into the developing and fixing liquid and into the rinsing water as would otherwise be the case.

After repeatedly carrying out the above operation, the developing and fixing liquid and/or the rinsing water may become polluted or deteriorated and may thus need to be replaced. The valves (not shown) in conduits 22 and 23 may therefore be opened by means of valve operating handles 31 and 32 for discharging these liquids from their respective tanks, whereafter the valves are closed for the replacement of fresh developing liquid and rinsing water.

Another embodiment of a film developing device according to the invention is illustrated in FIGS. 6 to 10. This device operates on the same basic principle as the aforedescribed device. A base plate 101*d* (FIG. 6) supports a pair of spaced plates 101*a* and 101*b* mounted thereto in parallel relation thereby forming a support body. A single developing tank 111 is fixedly mounted on the outer surface of plate 101*a*, and has a top lid 102 removably attached thereto in sealing relation by means of a fastener 103 which may be opened for permitting insertion and withdrawal of a film 129 (FIG. 10) to be developed and rinsed with water.

Shafts 104 and 105 extend between and are mounted to plates 101*a* and 101*b*, a pair of upper levers 114 being pivotally mounted between their ends on shaft 104 and a pair of lower levers 115 being pivotally mounted between their ends on shaft 105. Shafts 124 and 124' extend between and are secured to one end of levers 114 and 115, respectively, and a developing and fixing liquid tank 112 is mounted at the top and bottom thereof for pivotal movement on these shafts 124 and 124'. Similarly, shafts 125 and 125' extend between and are connected to opposite ends of levers 114 and 115, respectively, and a rinsing water tank 113 is supported at the top and bottom thereof for pivotal movement on these shafts 125 and 125'. Thus, a parallelogram pantograph-link mechanism is formed.

Tank 112 is connected through the bottom thereof to tank 111 by means of a first flexible conduit 106 having a valve therein capable of being opened and closed by a valve operating or stopcock handle 109. Similarly, the bottoms of tanks 111 and 113 are interconnected by a second flexible conduit 107 having a valve therein adapted to be opened and closed by a valve operating handle 110. A screw cap 126 (FIGS. 6 and 7) covers an opening (not shown) in the top wall of tank 112 provided for filling tank 112 and emptying it of developing and fixing liquid 118. Similarly, a screw cap 127 (FIG. 7) covers an opening (not shown) in the top wall of tank 113 provided for filling tank 112 and emptying it of rinsing water 119.

In the operation of this second embodiment, levers 114 and 115 may be swung throughout 90° from a first position of FIG. 10A wherein tank 112 is positioned above tank 111 with tank 113 positioned therebelow, to a second position of FIG. 10C wherein tanks 113 and 112 are respectively positioned above and below developing tank 111.

Figure 10A:
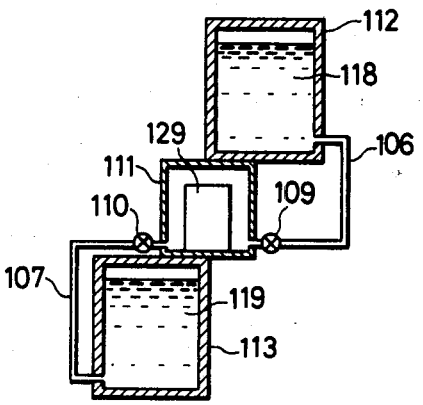
FIGS. 10A through 10G are longitudinal sectional views of the FIG. 6 tanks showing the manner in which the outer tanks are shifted relative to the central tank in carrying out the film developing and rinsing operations.
Figure 10B:
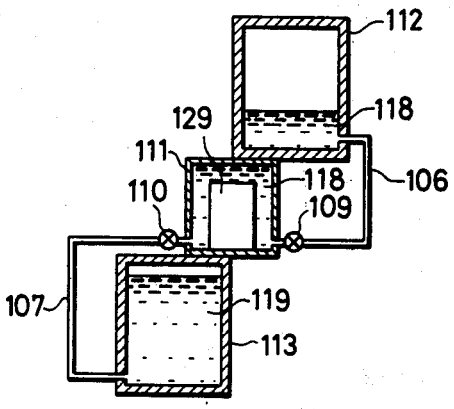
Figure 10C:
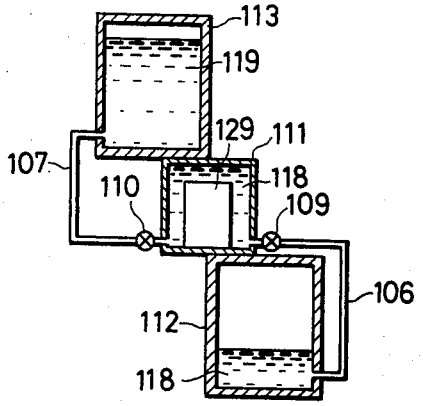
Figure 10D:
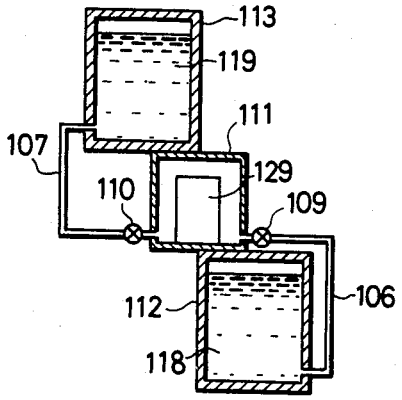
Figure 10E:
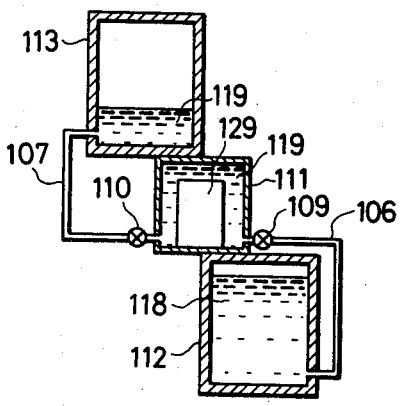
Figure 10F:
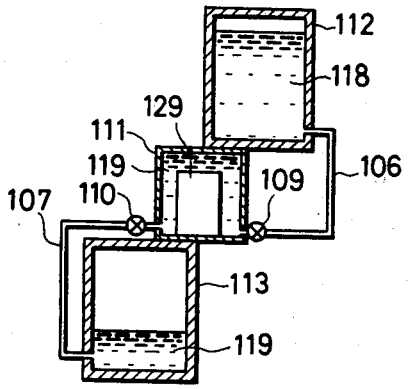
Figure 10G:
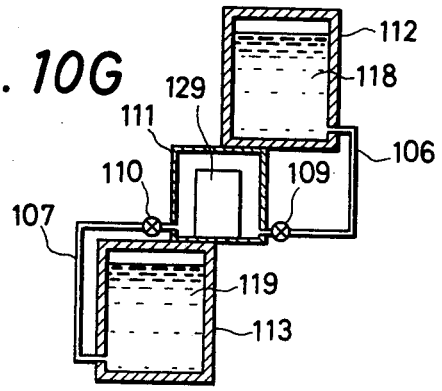

Before swinging tanks 112 and 113 into their position of FIG. 10A, valve operating handles 109 and 110 are placed in a closed position so as to maintain developing tank 111 empty while film 129 to be developed is inserted therein upon the opening of lid 102. Handle 109 is then placed in an open position thereby allowing developing and fixing liquid 118 to flow by gravity from tank 112 through first conduit 106 into the bottom of developing tank 111 as shown in FIG. 10B, thereby commencing the development of film 129. Thereafter, handle 109 is placed in a closed position with handle 110 remaining in its closed position while tanks 112 and 113 are swung into their second position of FIG. 10C. After the lapse of sufficient developing time, handle 109 is moved to its open position allowing the developing and fixing liquid to empty by gravity from tank 111 back into tank 112, as shown in FIG. 10D. When developing tank 111 is completely empty, handle 110 of second conduit 107 is placed in an open position to thereby allow rinsing water 119 to flow by gravity from tank 113 through conduit 107 into developing tank 111 until developing tank is filled with rinsing water as shown in FIG. 10E. Handle 110 is thereafter placed back into its closed position and levers 114, 115 are swung throughout 90° back into the first position shown in FIG. 10F wherein tank 112 is positioned above and tank 113 is positioned below developing tank 11. Upon completion of the water rinsing operation, handle 110 is moved into its open position thereby allowing the rinsing water to flow by gravity from tank 111 back into rinsing water tank 113 as shown in FIG. 10G. Of course, while handle 110 is opened, handle 109 is maintained in a closed position. And, when developing tank 111 is emptied, handle 110 is again moved to its closed position, lid 102 of the developing tank is removed and the developed and water rinsed film 129 is removed from tank 111 and replaced by another film to be developed. By repeating the aforedescribed operation, a plurality of film such as microfiches and the like may be developed and photographically fixed in sequence. When developing liquid 118 and rinsing water 119 become polluted or deteriorated, screw caps 126 and 127 are removed for draining the liquid and replacing them with fresh liquids.

It should be noted that tanks 12, 11 and 13 are referred to elsewhere in this application as first, second and third tanks, respectively, and that tanks 112, 111 and 113 are likewise referred to as first, second and third tanks, respectively.

Figure 11:
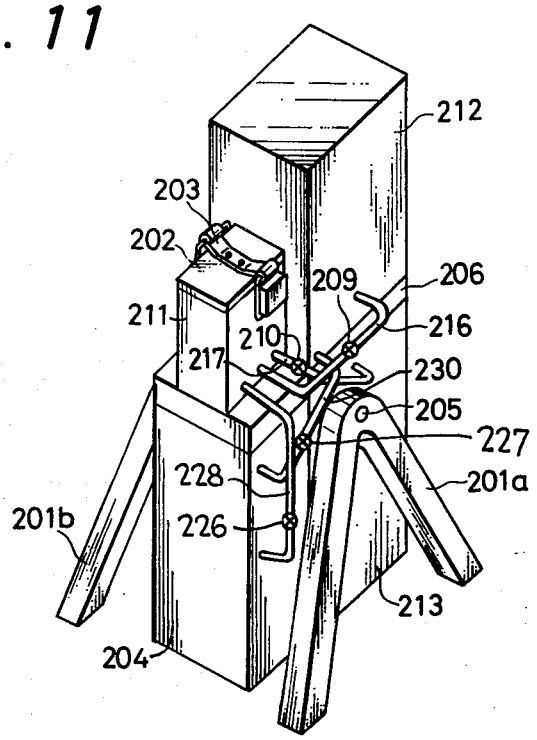
FIG. 11 is a perspective view of yet another embodiment of a device according to the invention.

Yet another embodiment of the device according to the invention is illustrated in FIGS. 11 and 12 which is basically similar in operation to that of the first and second aforedescribed embodiments. However, developing tanks 11 and 111 of the earlier described embodiments are fixedly mounted on their respective supports, while their developing and fixing tanks and their rinsing water tanks are swung into position relative thereto. In the third embodiment, on the other hand, developing tank 211, developing and fixing liquid tank 212 and rinsing water tank 213 are all pivoted about a common axis.

As shown in FIG. 11, a pivot shaft 205 extends outwardly of opposite sides of a base plate 206 and is pivotally supported on support legs 201*a* and 201*b*. A first tank 212 containing a quantity of developing and fixing liquid 218 is mounted on one surface of plate 206, and a second tank 211 in which film developing takes place is mounted on the same surface of base plate 206 adjacent tank 212. The size of tank 211 is smaller than that of tank 212, and a lid 202 is provided for closing the open end of tank 211 which is sealed closed by a fastener assembly 203. A film rack (not shown) is provided in tank 211 for supporting a film 229 (FIG. 12) therein.

A third tank 213 containing a quantity of rinsing water 219 is mounted on the opposite surface of base plate 206, and a fourth tank 204 for storing developing liquid therein is likewise mounted on this same surface of the base plate adjacent tank 213. The size of the fourth tank 204 is substantially equal to that of tank 211, although the size of the third tank 213 is larger than that of second tank 211.

A U-shaped first conduit 216 interconnects the bottoms of tanks 211 and 212, and has the first valve 209 therein which may be manually operated similarly as the conduit valves disclosed in the first and second embodiments for opening and closing same. A second conduit 228 interconnects tanks 211 and 204 near the bottoms thereof for permitting developing liquid to flow by gravity from second chamber 211 into fourth chamber 204 as valve 226 therein is opened. A third conduit 217 interconnects tanks 211 and 213 near the bottoms thereof such that, when third tank 213 is positioned upwardly as in FIG. 12E, rinsing water 219 is allowed to flow by gravity into second tank 211, and when second tank 211 is positioned upwardly as in FIG. 12F, rinsing water 219 is made to flow by gravity from tank 211 into tank 213. A third valve 210 is provided in conduit 217 and is manually operable for opening and closing same as by a valve handle or stopcock as described for the earlier embodiments. In addition, a fourth conduit 230 interconnects tanks 212 and 204 such that, when tank 204 is positioned upwardly as in FIG. 12E, developing and fixing liquid 218 is returned from the fourth tank into first tank 212 through an open valve 227 adapted for manual opening and closing. Also, a heater 236 is provided in first tank 212 for heating the developing and fixing liquid 218 similarly as in the manner described for the first embodiment.

Figures 12A, 12B, 12C:
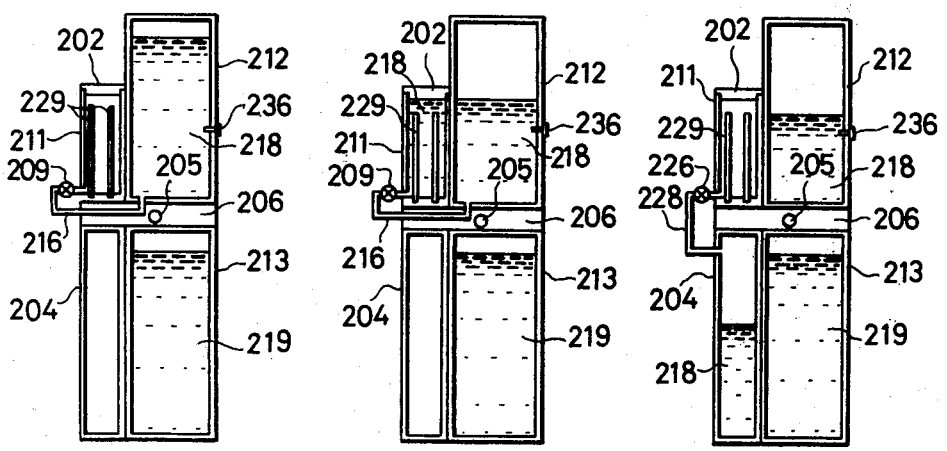
FIGS. 12A through 12G are vertical sectional views of the FIG. 11 device illustrating the step-by-step manner in which the film developing and rinsing operations are carried out.

In operation of the third embodiment of the film developing device according to the invention, all the valves 209, 210, 226 and 227 are closed, film 229 to be developed is loaded into tank 202, tanks 202 and 212 are positioned upwardly as in FIG. 12A, and tanks 212 and 213 are filled in any normal manner, respectively with developing and fixing liquid 218 and with rinsing water 219. In this condition, fourth tank 204 remains empty.

When first valve 209 is opened, developing and fixing liquid 218 in first tank 212 flows by gravity through conduit 216 into second tank 211, as shown in FIG. 12B. When the levels in both tanks are substantially equal, the flow of liquid 218 stops and the development of film 229 commences while being immersed in liquid 218. Valve 209 may then be closed and the device may be rotated back and forth throughout a small angle about shaft 205 for agitating liquid 218 in tank 211, thus aiding in the process of film developing.

Figure 12D:
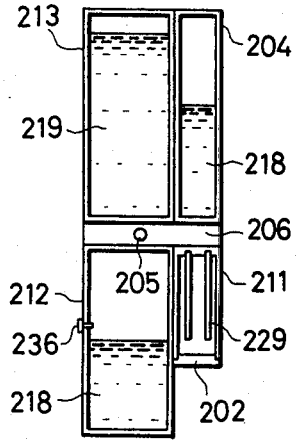
Figure 12E:
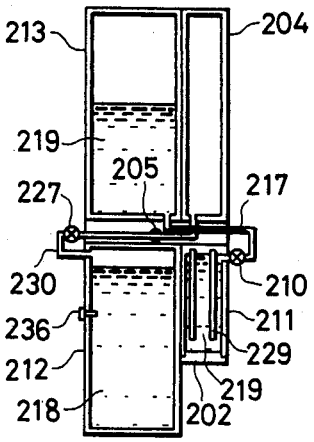
Figure 12F:
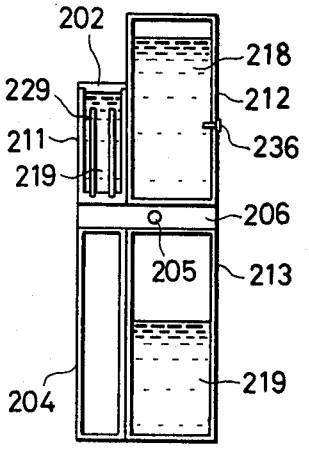
Figure 12G:
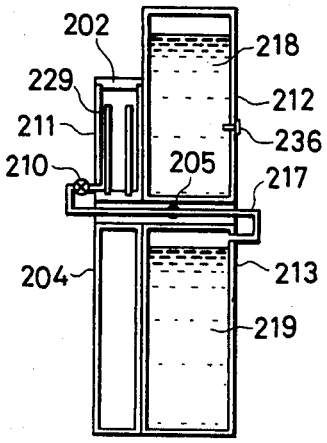

After a lapse of a predetermined amount of time for completing the developing operation, valve 226 is opened while the tanks are in their position of FIG. 12C and developing liquid in second tank 211 flows through conduit 228 into the empty fourth tank 204. Valve 226 is then closed and the developing device is swung through an angle of 180° on shaft 205 so that tanks 213 and 204 are positioned upwardly, and tanks 212 and 211 are positioned downwardly, as shown in FIG. 12D. Third valve 210 may then be opened so as to permit rinsing water 219 to flow by gravity from third tank 213 through conduit 217 into second tank 211, thereby commencing the water rinsing of developed film 229. And, while in the position of FIG. 12E, valve 227 is opened to permit liquid 218 to return by gravity flow from fourth tank 204 to first tank 212. Thereafter, valves 210 and 227 are closed, and the developing device is swung through an angle of 180° into its position of FIG. 12F so that chambers 212 and 211 are positioned upwardly and chambers 204 and 213 are positioned downwardly. When valve 210 is opened, rinsing water 219 flows by gravity from tank 211 into tank 213 through conduit 219, as shown in FIG. 12G, thus completing one cycle of the development and water rinsing operations. The developed and water rinsed film may then be replaced by another film to be developed after lid 202 of second tank 211 is removed.

If developing liquid 218 and rinsing water 219 need to be replaced when they become deteriorated, plugs or sealed openings may be provided as required for draining and replacing these liquids. Also, it should be pointed out that only those conduits and valves associated with the opening and closing operations of the various stages are shown in 12A through 12G, while the others are omitted for the sake of clarity.

Obviously, many modifications and variations of the present invention are made possible in the light of the above teachings. It is therefore to be understood that within the scope of the appended claims the invention may be practiced otherwise than as specifically described.

We claim:

1. A single bath-type film developing device, comprising: a support member, a first tank mounted on said support member and containing a quantity of developing and fixing liquid, a second tank mounted on said support member and being adapted for receiving film to be developed through an open top end thereof, means on said second tank for closing and sealing said open end, a third tank mounted on said support member and containing a quantity of rinsing water, a fist conduit interconnecting said first and second tanks and having a first valve thereon, a second conduit interconnecting said second and third tanks and having a second valve therein, said first and second tanks each being mounted for pivotal movement for respectively altering the level of liquid and water therein relative to said second tank, whereby the film may be developed as said second tank is filled with the liquid from said first tank through said first conduit upon opening said first valve while the liquid level is above said second tank, and whereby the developed film may be rinsed as the liquid is emptied from said second tank back into said first tank and the water fills said second tank respectively through said conduits upon opening said first valve and then said second valve while the water level is above said second tank.

2. The device according to claim 1, wherein said first and third tanks each have means thereon for draining the contents thereof.

3. The device according to claim 1, wherein said first tank is provided with means for maintaining the liquid stored therein at a predetermined temperture.

4. The device according to claim 1, wherein drying means are associated with said second tank for drying the rinsed film therein.

5. The device according to claim 1, wherein said support member includes a pair of spaced walls, a pivot shaft spanning said walls, said second tank being fixedly mounted on said support member, said first and third tanks being spaced from said shaft and being mounted for pivotal movement thereabout, means on said first and second tanks to facilitate pivotal movement thereof, and means on one of said walls for locking said first mentioned means in a predetermined position.

6. A single bath-type film developing device, comprising: a support member, a support base mounted for pivotal movement on said member about a horizontal axis, a first tank mounted on one surface of said base and containing a quantity of developing and fixing liquid, a second tank mounted on said one surface and being adapted for receiving film to be developed through an open end thereof, means on said second tank for closing and sealing said open end, a third tank mounted on a surface of said base opposite said one surface and containing a quantity of rinsing water, a fourth tank mounted on said opposite surface and being adapted for storing the liquid, a first conduit interconnecting said first and second tanks and having a first valve therein, a second conduit interconnecting said second and fourth tanks and having a second valve therein, a third conduit interconnecting said second and third tanks and having a third valve therein, a fourth conduit interconnecting said first and fourth tanks and having a fourth valve therein, whereby the film may be developed as said second tank is filled with the liquid through said first conduit upon opening said first valve while said one surface is uppermost, and whereby the developed film may be rinsed as the liquid is emptied from said second tank into said fourth tank upon opening said second valve, the water filling said second tank upon opening said third valve while said opposite surface is uppermost, and the liquid emptying back into said first tank from said fourth tank upon opening said fourth valve while said opposite surface is uppermost.

* * * * *